US005636734A

United States Patent [19]

Smith

[11] Patent Number: 5,636,734

[45] Date of Patent: Jun. 10, 1997

[54] GOLF CLUB HOLDER

[76] Inventor: James F. Smith, 431 Oak Ridge, Fairview, Tex. 75069

[21] Appl. No.: 479,692

[22] Filed: Jun. 7, 1995

[51] Int. Cl.[6] ..... A63B 55/00

[52] U.S. Cl. ..... 206/315.2; 206/315.6; 211/70.2; 248/96

[58] Field of Search ..... 206/315.2, 315.3, 206/315.6; 211/70.2; 248/96

[56] References Cited

U.S. PATENT DOCUMENTS

| | | | |
|---|---|---|---|
| 1,756,902 | 4/1930 | Boyce . | |
| 2,595,987 | 5/1952 | Shears . | |
| 3,053,298 | 9/1962 | Stamp | 206/315.2 |
| 3,554,255 | 1/1971 | Mangan . | |
| 4,100,652 | 7/1978 | Carlson | 206/315.3 |
| 4,860,889 | 8/1989 | Lemieux et al. . | |
| 4,932,523 | 6/1990 | Yamazoe . | |
| 5,148,915 | 9/1992 | Ryan . | |
| 5,238,109 | 8/1993 | Smith . | |
| 5,332,090 | 7/1994 | Tucker . | |
| 5,447,228 | 9/1995 | Hodgson, III | 206/315.3 |
| 5,495,983 | 3/1996 | Lelek | 206/315.2 |

*Primary Examiner*—Paul T. Sewell
*Assistant Examiner*—Nhan Lam
*Attorney, Agent, or Firm*—Harris, Tucker & Hardin, P.C.

[57] ABSTRACT

A light-weight golf club holder fits over the crossbars of a golf bag and holds clubs on both sides of the crossbar. A second version fits the intersection of two crossbars and holds clubs in the angles formed by the crossbars.

30 Claims, 6 Drawing Sheets

GOLF CLUB HOLDER

BACKGROUND AND SUMMARY OF THE INVENTION

This invention relates generally to golf club holders which hold golf clubs securely within a golf bag, preventing damage to the clubs and holding them in organized positions.

Problems of Loose Clubs

Golf is a popular game, and an enthusiast may invest considerable time and money pursuing this recreation. Buying a quality set of irons alone may cost well over $1,000, so taking care of the clubs is important. Likewise, being able to find a particular club quickly can enhance enjoyment of the game. Golf bags provide a way to keep the clubs together and provide some protection and order, but clubs can move around within a bag and hence be more difficult to locate, as well as potentially causing damage to each other. One current solution to this problem is a set of tubes that fit in the bag, each tube holding the shaft of a single club, so that they are separated from each other. The problem with this solution is that the tubes provide a loose enough fit that the golf club can still move within the tube; this can cause visible wear rings to appear around the golf club.

Other solutions have been tried, with varying degrees of success, but no definitive solution has been found. Ideally, such a club holder would be lightweight, inexpensive, easily adaptable to different styles of bags, easy to retrofit to existing bags, would hold clubs securely, in easily accessible positions, and would offer no difficulty in removal of the clubs during play.

Innovative Solution

The innovative club holder herein disclosed solves these problems. A U-shaped base fits over the crossbars of a golf bag. Several clips, which in the currently preferred embodiment are of a single piece with the base, grip the shaft of a golf club. Two opposable arms of the clip fit snugly around the shaft of a club, with a gap between. The arms will deform slightly under pressure, allowing clubs to be removed or replaced in the clip while giving a snug fit when the club is in place.

Several versions of the club holder have been designed, to allow for the differences in bags, the golfer's needs, and individual tastes. In a first embodiment, a straight section of base fits over a straight section of the crossbar, with two clips on either side of the base as it would be seen looking down into a golf bag. This embodiment will fit almost any bag. In a second embodiment, again seen from above, sections of the base run perpendicular to each other, forming an X-shaped section which will fit the intersection of two crossbars; a single clip fits into each of the four right angles formed by the base. Both of these embodiments hold up to four clubs each. A third contemplated embodiment is similar to the first embodiment, but has clips on only one side of the base. This would be particularly helpful where space requirements preclude the use of clips on both sides of the base.

Bag Variations and Use of Inventive Clip

The most common golf club bag is one that has basically six compartments to hold the clubs, the compartments being defined by crossbars in the mouth of the bag. One crossbar describes a diameter of the bag, and two more crossbars intersect the first crossbar (running perpendicular to it). The rules of golf allow 14 clubs in a bag, though some golfers carry more or fewer. A golfer who has this type of bag may choose to use one of the X-shaped holders in conjunction with several of the straight-base holders to have a secure storage for each club in the bag. Alternatively, two of the X-shaped holders can provide storage for eight clubs; the remainder of the set can then remain loose in the bag. The clubs are easy to locate and damage is reduced.

One variation on the more common golf bag is to have the crossbars intersecting in something other than a right angle. In this type of bag, it would not be possible to use the X-shaped bases, but it would be possible to use the straight pieces to customize this type of bag.

Advantages

The disclosed invention provides at least the following advantages:

Because it slips over the crossbars in the golf bag, this innovative club holder is easy to fit to new bags, or to retrofit to older bags equally well. The preferred embodiments of the innovative holder are of plastic, so they are light-weight and impervious to the weather. By providing a means to hold clubs on either side of the crossbar, or in each corner of an intersection, the space within the bag can be better utilized than previously.

The innovative holder also maintain a low profile in the bag, so that no part sticks out to get in the way; it is less likely to get broken or beat up than anything which rises above the opening of the bag.

Using several of the inventive holders allows the clubs to be organized better, so that each has a definite place in the bag. In addition to making it easier to find a particular club when the golfer wants it, organizing the clubs makes it less likely that a club will be laid down and forgotten, as may sometimes happen when several clubs are taken out of the bag and carried to the site of a shot.

The holder also provides protection for travel or shipping, e.g. as checked baggage for air travel.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment. However, it should be understood that this class of embodiments provides only a few examples of the many advantageous uses of the innovative teachings herein. In general, statements made in the specification of the present application do not necessarily delimit any of the various claimed inventions. Moreover, some statements may apply to some inventive features but not to others.

Figure 1:
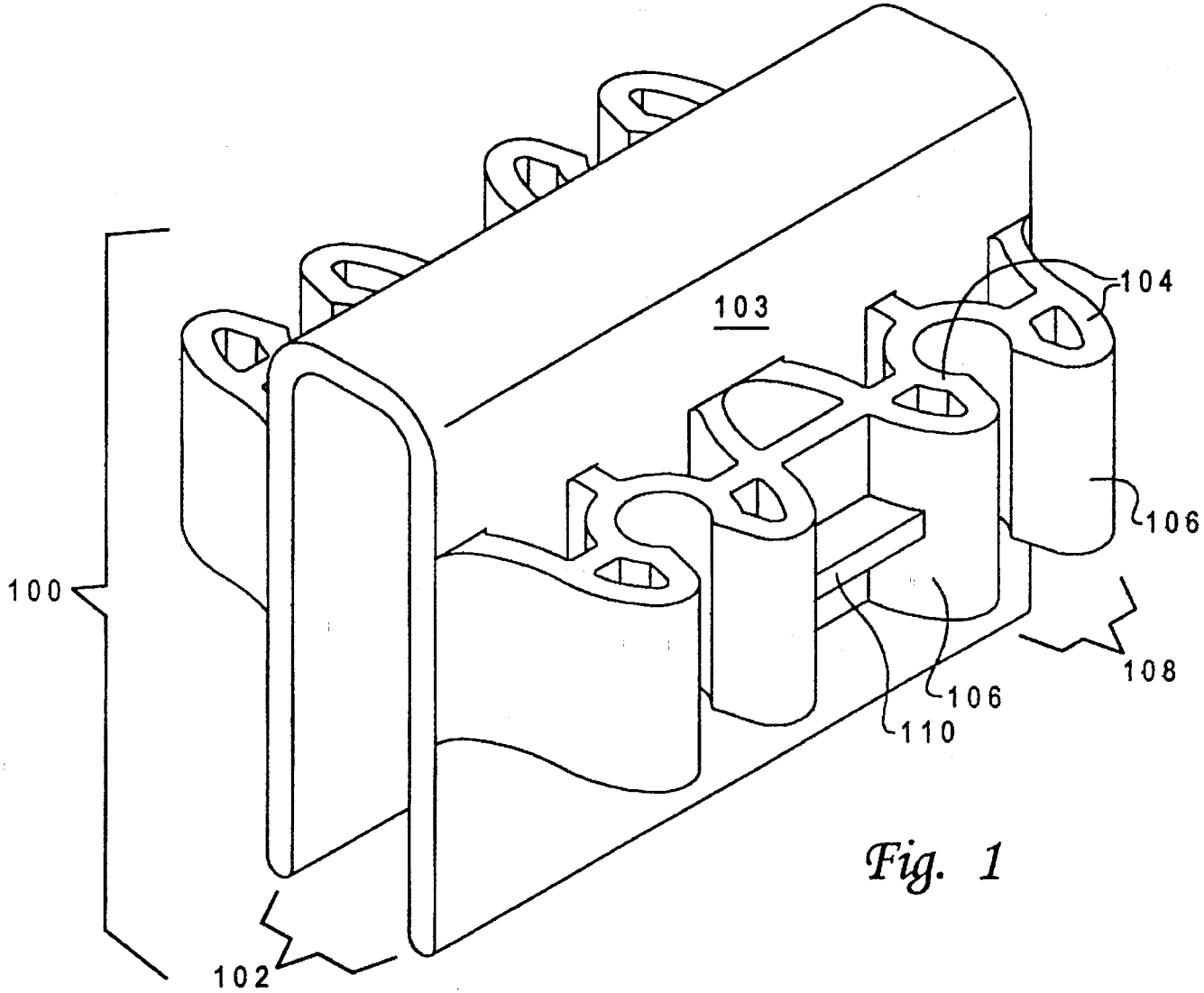
FIG. 1 shows a first embodiment of the disclosed invention, a straight version which holds clubs on either side of the divider.

Referring to FIG. 1, a first embodiment 100 of the invention is shown. The base 103 has a U-shaped cross-section. The arms of the "U" enclose a gap 102, which fits snugly over the crossbar of a typical golf bag. Attached to the base, and of a piece with it, are clips 104 which will securely hold the shaft of a golf club in place. The currently preferred embodiment has two such clips on either side of the base, for a total of four clubs held at once. Each clip has two fingers 106, which oppose each other, leaving a gap 108 between them. When the shaft of a golf club is pushed between the two fingers, one or both of the fingers will deform slightly to allow the shaft to pass through. A brace 110 between the inner fingers of two adjacent clips means that these will deform less than the outer arms. The base of the holder has been sized so that one can be installed on any straight section of crossbar in the most common styles of golf bags. One contemplated variation on this embodiment (not shown) is a straight base with clips on only one side of the base. This will allow use of the innovative holder in a bag in situations where space considerations preclude the use of the two-sided version.

The presently preferred embodiment of the inventive club holder is molded from a urethane type thermoplastic, using a standard molding process. Note that the fingers of the clips are formed of an open lattice-work of plastic which allows it to be both flexible, durable and lightweight.

Figure 2:
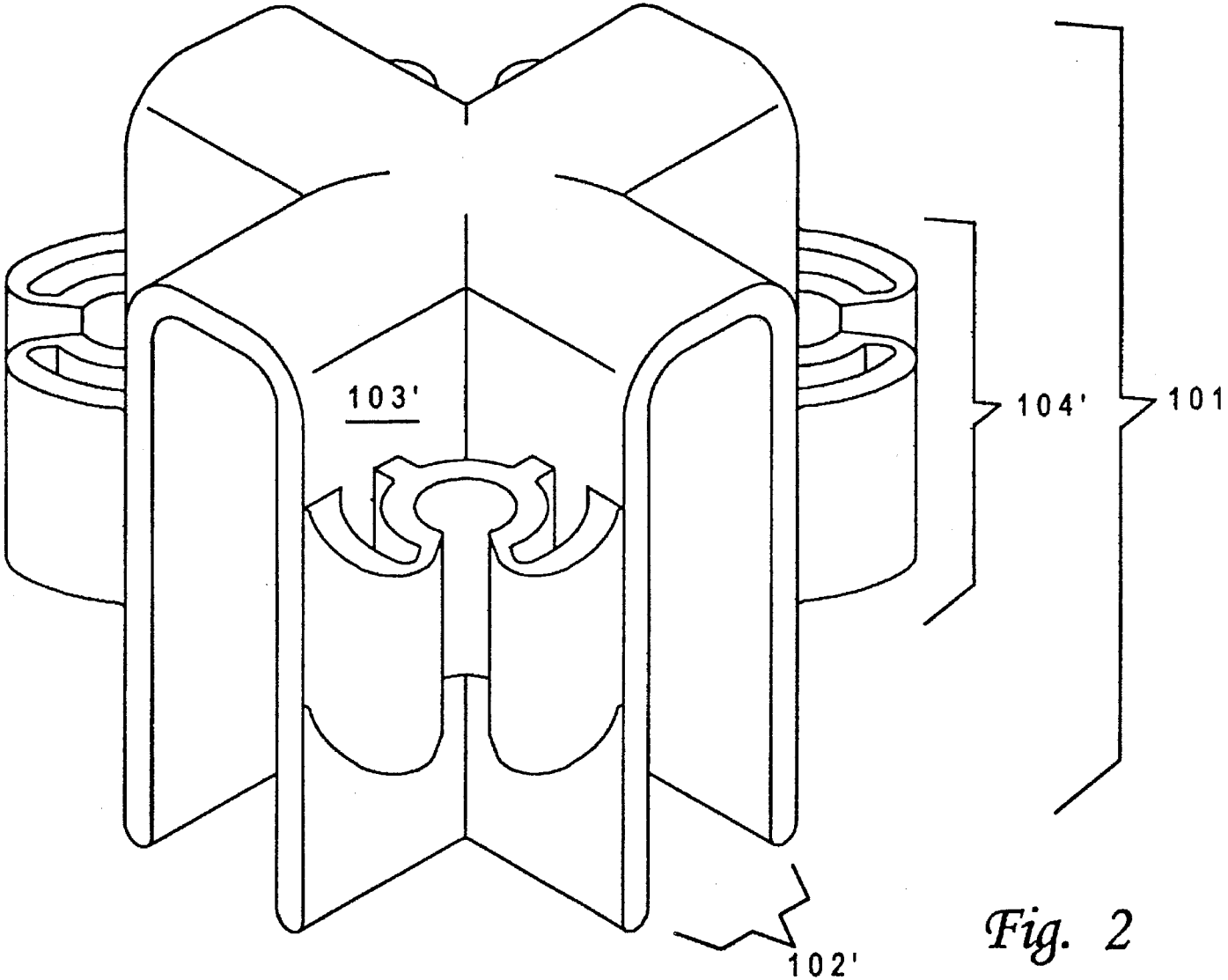
FIG. 2 shows a second embodiment of the disclosed invention, with an x-shaped version of the inventive holder fitting over the right-angle intersection of two cross-bars in the golf bag.

FIG. 2 shows a second embodiment 101 of the invention, in which the base 103' is designed to fit over the intersection of two perpendicular crossbars in a bag. The base of this version has an overall X-shape, with the clips 104' arranged in the interior angles of the X. The design of the clips is slightly different to adjust to the different space to which it must fit.

Figure 3:
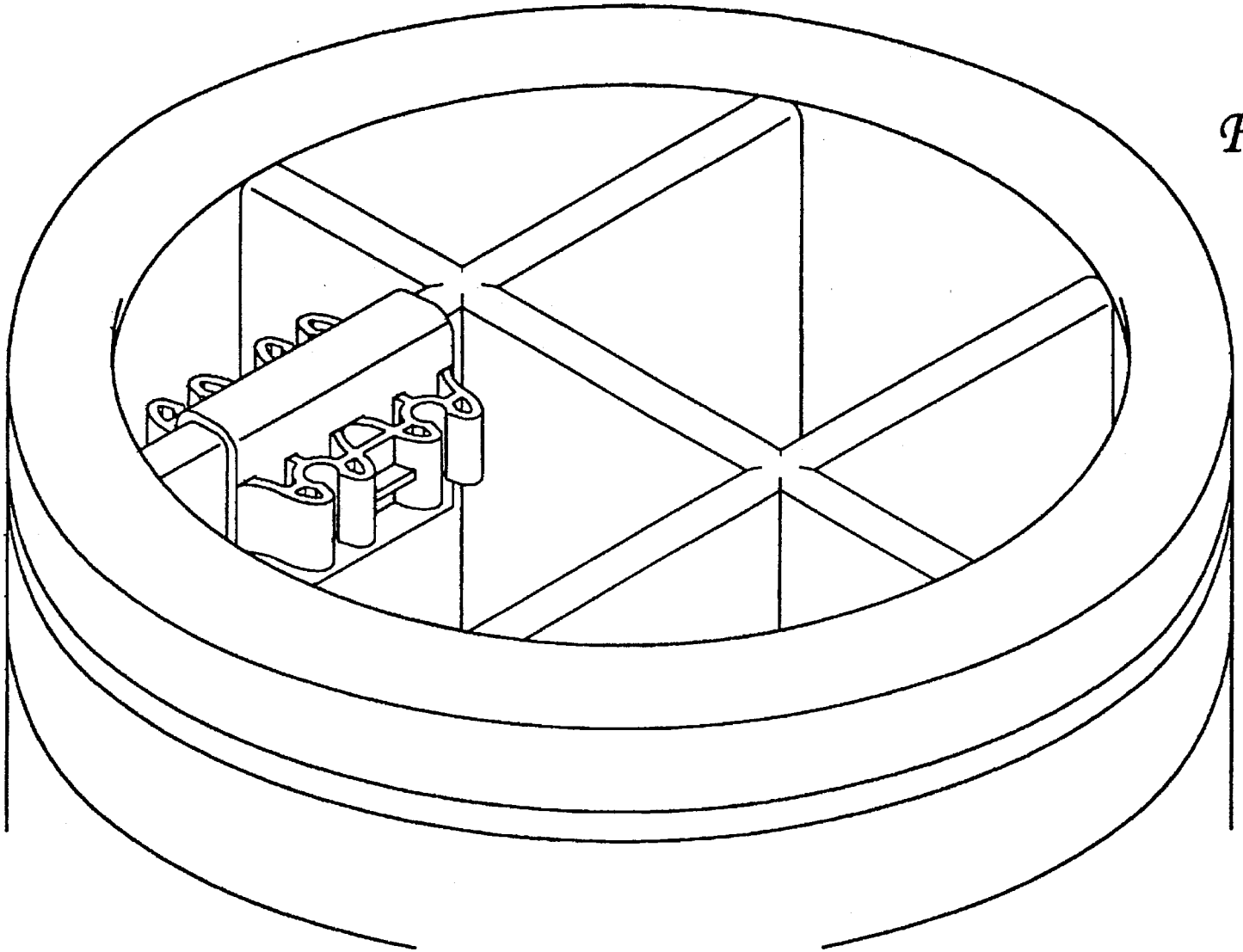
FIG. 3 shows the straight version of the invention installed in a golf bag.
Figure 4:
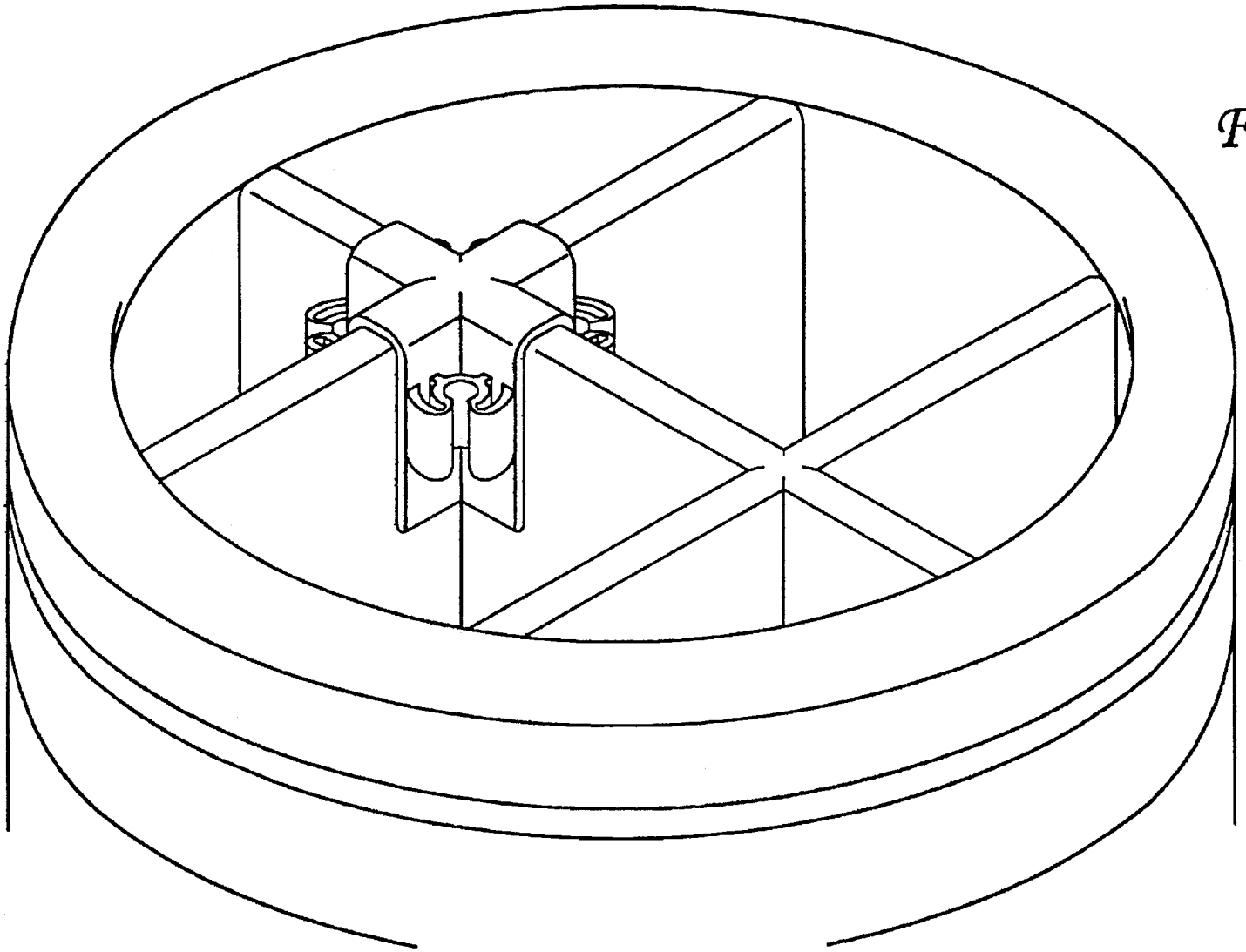
FIG. 4 shows the x-shaped version of the invention installed in a golf bag.

FIGS. 3 and 4 show the first and second embodiments respectively as they would be installed in the currently most popular golf bag. Size constraint would preclude the use of the straight pieces immediately adjacent to an X-shaped piece, but since only 14 clubs are allowed in the bag in regulation play, this should not present any problems. For instance, either four of the straight holders or two of the X-shaped holders can be used in a standard bag to hold a maximum of 16 or 8 clubs respectively.

Figure 5A:
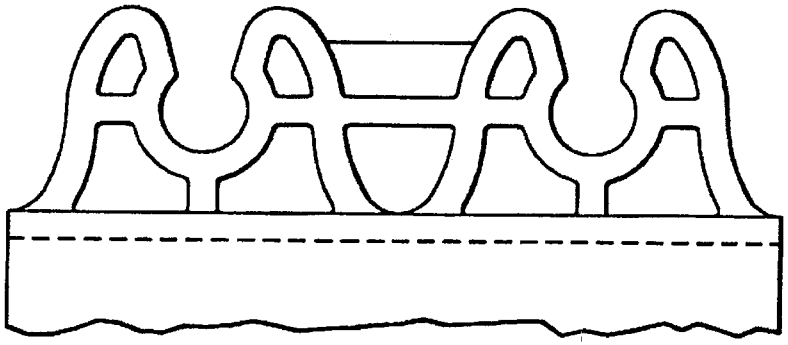
FIGS. 5A, 5B, and 5C show scaled drawings of the straight version of the club holder.
Figure 5B:
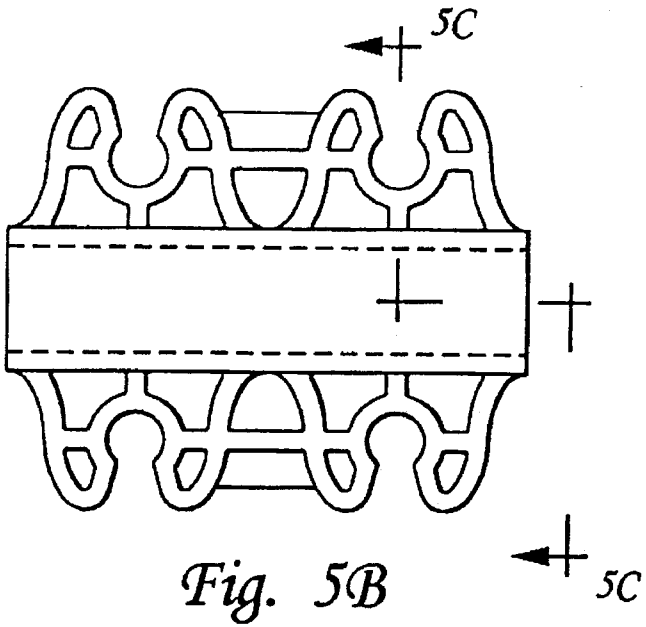
Figure 5C:
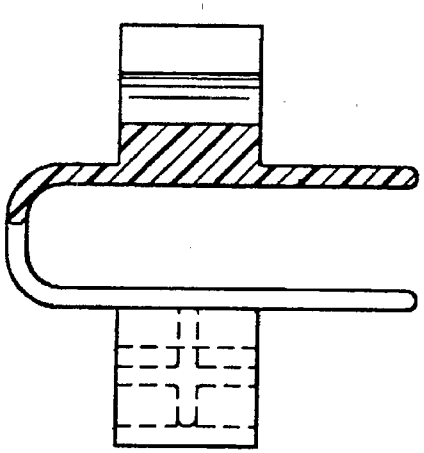

FIGS. 5A, 5B and 5C show scale drawings of the first embodiment 100. FIG. 5A shows several clips, FIG. 5B is a top view of the holder, and FIG. 5C is a side view of the holder respectively. As shown, each arm of the base has a length of 2.200 inches, the gap between the arms has a width of 0.563 inches, and the total length of the holder is 2.75 inches. For the clamps, the area enclosed by the arms, which will hold the shaft of the club, has a radius of 0.129 inches, while the gap between the ends of the arms is 0.200 inches.

Figure 6B:
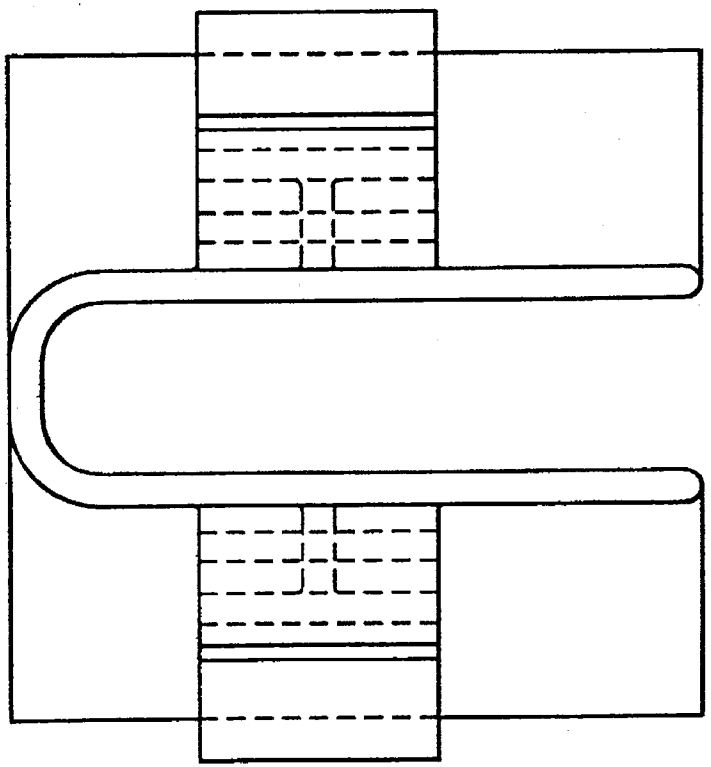
FIGS. 6A and 6B show scaled drawings of the x-shaped version of the club holder.
Figure 6A:
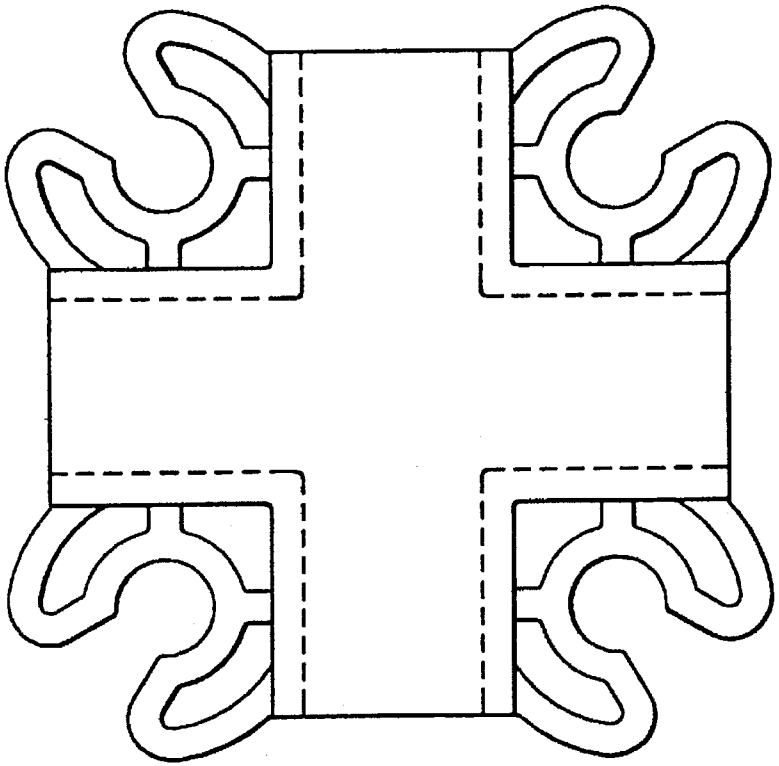

Similarly, FIGS. 6A and 6B show scale drawings of the second embodiment 101. FIG. 6A shows a top view of the base and clips, while FIG. 6B shows a side view.

According to a disclosed class of innovative embodiments, there is provided: A golf club holder, comprising: a base having a substantially U-shaped cross-section, wherein said base is designed to fit over the cross-bars of a golf bag; clips attached to both sides of said base; wherein said clips are dimensioned to securely hold the shaft of a golf club.

According to another disclosed class of innovative embodiments, there is provided: A golf club holder, comprising: a base having a substantially U-shaped cross-section in two normal planes, wherein said base is shaped to fit over the intersection of two crossbars of a golf bag; clips attached to said base; wherein said clips are shaped to securely hold the shaft of a golf club.

According to another disclosed class of innovative embodiments, there is provided: A golf club holder, comprising: a base having a substantially U-shaped cross-section, wherein said base is designed to fit over the cross-bars of a golf bag; clips attached to at least one side of said base, wherein said clips are formed in an open-lattice-work configuration; wherein each of said clips securely holds the shaft of a golf club.

According to another disclosed class of innovative embodiments, there is provided: A golf club holder, comprising: a base which fits over a crossbar of a golf bag; clips attached to both sides of said base, said clips being formed integrally with said base; wherein said clips are shaped to securely hold the shaft of a golf club.

According to another disclosed class of innovative embodiments, there is provided: A golf bag for carrying golf clubs, said golf bag comprising: a bag having a mouth which allows golf clubs to be inserted into said bag; crossbars which traverse the mouth of said golf bag; at least one golf club holder, said holder comprising: a base which is designed to fit over at least one of said crossbars; clips attached to said base, ones of said clips occupying the angles formed by the intersection of said crossbars; wherein ones of said clips are dimensioned to securely hold the shaft of a golf club.

According to another disclosed class of innovative embodiments, there is provided: A golf bag for carrying golf clubs, said golf bag comprising: a bag having a mouth through which golf clubs can be inserted into said bag; at least one crossbar positioned in the mouth of said bag; and at least one golf club holder affixed to said crossbar and comprising: a base which fits over said crossbar; clips attached to said base and positioned on opposite sides of said crossbar; wherein ones of said clips are dimensioned to securely hold the shaft of a golf club.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, in addition to the embodiments disclosed, other version can be extrapolated from those given, such as a base to fit over a cross-bar, but which had only three arms (to form a T-shape) and having two clips, or only two arms (to form a right angle) and only one clip.

Another embodiment can be designed to fit the intersection of the crossbar with the outside of the bag.

For another example, although the disclosed embodiment is a single piece, less preferred, the base and clips could be manufactured separately and assembled later with glue or another fastener.

For another example, other types of plastics may be used or other materials, such as a vinyl-clad steel or other materials which gave the necessary strength and flexible.

Another embodiment of the invention can be designed with "teeth", a roughened surface, or an adhesive on the inside of the base, to help keep the invention from slipping out of position.

What is claimed is:

1. A golf club holder, comprising:

a base having a substantially U-shaped cross-section and a first side, said base designed to fit over the crossbars of a golf bag;

first and second clips attached to said first side of said base, each one of said first and second clips having outer and inner fingers attached to and outwardly projecting from said first side of said base to define a gap therebetween; and a brace spaced forward of said first side, said brace extending said inner finger of said first clip and said inner finger of said second clip;

wherein said first and second clips are each dimensioned to securely hold the shaft of a golf club inserted into said gap defined by said first and second fingers thereof.

2. The golf club holder of claim 1, wherein said base and said first and second clips are formed of a polymeric material.

3. The golf club holder of claim 2, wherein said polymeric material is a urethane type thermoplastic.

4. The golf club holder of claim 1, wherein said base and said first and second clips are formed as a single piece.

5. The golf club holder of claim 1, wherein said first and second clips are formed in an open-lattice-work configuration.

6. A golf club holder, comprising:

a base having a substantially U-shaped cross-section in two normal planes, said base shaped to fit over the intersection of two crossbars of a golf bag;

said base extending in four directions from the intersection of said crossbars and having first and second sides for each angle formed by the intersection of said crossbars;

first, second, third and fourth clips, each attached to said base and occupying one of the angles formed by the intersection of said crossbars;

each said clip having first and second fingers attached to and outwardly projecting from said first and second sides, respectively, to define a gap therebetween;

wherein each said clip is shaped to securely hold the shaft of a golf club inserted into said gap defined by said first and second fingers thereof.

7. The golf club holder of claim 6, wherein said base and said first, second, third and fourth clips are formed of a polymeric material.

8. The golf club holder of claim 7, wherein said polymeric material is a urethane type thermoplastic.

9. The golf club holder of claim 6 wherein said base and said first, second, third and fourth clips are formed as a single piece.

10. The golf club holder of claim 6, wherein said first, second, third and fourth clips are formed in an open-lattice work configuration.

11. A golf club holder, comprising:

a base having a substantially U-shaped cross-section in two normal planes, said base shaped to fit over the intersection of two crossbars of a golf bag, said base extending in two directions from the intersection of said crossbars and having first and second sides for a first angle formed by the intersection of said crossbars;

a clip attached to said base and occupying said first angle formed by the intersection of said crossbars;

said clip having a first and second fingers attached to and outwardly projecting from said first and second sides, respectively, to define a gap therebetween;

wherein said clip is shaped to securely hold the shaft of a golf club inserted into said gap defined by said first and second fingers thereof.

12. A golf club holder, comprising:

a base having a substantially U-shaped cross-section and first and second sides, said base designed to fit over the crossbars of a golf bag;

first and second clips attached to said first side of said base, each one of said first and second clips having outer and inner fingers which outwardly project from said first side of said base to define a first gap therebetween;

a first brace spaced forward of said first side, said brace extending between said inner finger of said first clip and said inner finger of said second clip;

third and fourth clips attached to said second side of said base, each one of said third and fourth clips having outer and inner fingers which outwardly project from said second side of said base to define a second gap therebetween;

a second brace spaced forward of said second side, said second brace extending between said inner finger of said third clip and said inner finger of said fourth clip;

wherein each of said first, second, third and fourth clips securely holds the shaft of a golf club inserted into said gap defined by said first and second fingers thereof.

13. The golf club holder of claim 12, wherein said base and said first, second, third and fourth clips are formed of a polymeric material.

14. The golf club holder of claim 13, wherein said polymeric material is a urethane type thermoplastic.

15. The golf club holder of claim 12 wherein said base and said first, second, third and fourth clips are formed as a single piece.

16. A golf club holder, comprising:

a base which fits over a crossbars of a golf bag, said base having a first side;

first and second clips attached to said first side of said base, each one of said first and second clips having outer and inner fingers attached to and outwardly projecting from said first and side of said base, respectively, to define a gap therebetween; and a brace spaced forward of said first side, said brace extending between said inner finger of said first clip and said inner finger of said second clip;

wherein said first and second clips are shaped to securely hold the shaft of a golf club inserted into said gap defined by said first and second fingers thereof.

17. The golf club holder of claim 16 wherein said first and second clips are integrally formed with said base.

18. The golf club holder of claim 17 wherein said base and said first and second clips are formed of a polymeric material.

19. The golf club holder of claim 18, wherein said polymeric material is a urethane type thermoplastic.

20. A golf bag for carrying golf clubs, said golf bag comprising:

a bag having a mouth which allows golf clubs to be inserted into said bag;

crossbars which traverse the mouth of said golf bag;

at least one golf club holder attached to first and second ones of said crossbars, said holder comprising:

a base having a substantially U-shaped cross-section in two normal planes and designed to fit over said first and second ones of said crossbars;

said base extending in four directions from the intersection of said first and second ones of said crossbars and having first and second sides for each angle formed by the intersection of said first and second ones of said crossbars;

first, second, third and fourth clips, each attached to said base and occupying one of the angles formed by the intersection of said first and second ones of said crossbars;

each said clip having first and second fingers attached to and outwardly projecting from said first and second sides, respectively, to define a gap therebetween;

wherein each said clip is dimensioned to securely hold the shaft of a golf club inserted into said gap defined by said first and second fingers thereof.

21. The golf bag of claim 20 wherein said base and said first, second, third and fourth clips are formed of a polymeric material.

22. The golf bag of claim 21, wherein said polymeric material is a urethane type thermoplastic.

23. The golf bag of claim 20 wherein said base and said first, second, third and fourth clips are formed as a single piece.

24. The golf bag of claim 20 wherein said first, second, third and fourth clips are formed in an open-lattice-work configuration.

25. A golf bag for carrying golf clubs, said golf bag comprising:

a bag having a mouth through which golf clubs can be inserted into said bag;

at least one crossbar positioned in the mouth of said bag;

at least one golf club holder affixed to said crossbar and comprising:

a base which fits over said crossbar and has first and second sides;

first and second clips attached to said first side of said base, each one of said first and second clips having outer and inner fingers which outwardly project from said first side of said base to define a first gap therebetween;

a first brace extending between said inner finger of said first clip and said inner finger of said second clip;

third and fourth clips attached to said second side of said base, each one of said third and fourth clips having outer and inner fingers which outwardly project from said first side of said base to define a second gap therebetween; and a second brace extending between said inner finger of said third clip and said inner finger of said fourth clip;

wherein said first, second, third and fourth clips are each dimensioned to securely hold the shaft of a golf club inserted into said gap defined by said first and second fingers thereof.

26. The golf bag of claim 25, wherein said base has substantially U-shaped cross-section.

27. The golf bag of claim 25, wherein said base and said first, second, third and fourth clips are formed of a polymeric material.

28. The golf bag of claim 27, wherein said polymeric material is a urethane type thermoplastic.

29. The golf bag of claim 25, wherein said base and said first, second, third and fourth clips are formed as a single piece.

30. The golf bag of claim 25, wherein said first, second, third and fourth clips are formed in an open-lattice-work configuration.

* * * * *